US006600254B2

(12) United States Patent
Tu et al.

(10) Patent No.: US 6,600,254 B2
(45) Date of Patent: Jul. 29, 2003

(54) QUARTZ METAL HALIDE LAMPS WITH HIGH LUMEN OUTPUT

(75) Inventors: Junming Tu, Bath, NY (US); Kevin Dombrowski, Painted Post, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 19 days.

(21) Appl. No.: 09/749,138

(22) Filed: Dec. 27, 2000

(65) Prior Publication Data

US 2002/0079794 A1 Jun. 27, 2002

(51) Int. Cl.[7] ..... H01J 1/02
(52) U.S. Cl. ..... 313/25; 313/34
(58) Field of Search ..... 313/25, 34, 44, 313/45, 627, 634, 635, 636, 638

(56) References Cited

U.S. PATENT DOCUMENTS 4,479,071 A 10/1984 T'Jampens et al. ..... 313/25
5,001,384 A 3/1991 Bens et al. ..... 313/25
5,394,057 A * 2/1995 Russell et al. ..... 220/2.1 R
5,598,063 A * 1/1997 Mathews et al. ..... 313/623
5,610,469 A * 3/1997 Bergman et al. ..... 313/112
5,668,440 A * 9/1997 Inukai et al. ..... 313/489

FOREIGN PATENT DOCUMENTS

CA 2062889 A1 10/1992 ..... H01J/61/34
DE 3134907 A1 9/1982 ..... H01J/61/35

* cited by examiner

*Primary Examiner*—Don Wong
*Assistant Examiner*—Minh D A
(74) *Attorney, Agent, or Firm*—Ernestine C. Bartlett

(57) ABSTRACT

High lumen output quartz metal halide lamps are provided which comprise a vacuum outer fill, and a silicon nitride CVD coating on the outside of the quartz arc tubes (discharge tubes). Instead of nitrogen filled outers, vacuum lamp outers are used to reduce energy loss (since heat conduction loss is reduced) and to increase lumen output. Additionally, only the outside of the arc tubes is coated with silicon nitride, without coating the metal components. This reduces or blocks sodium diffusion through the quartz walls. The silicon nitride coating also retards migration of the trace hydrogen from the lamp outer into the arc tube. At least about a 10% increase, and preferably a 15% increase in lumen output is realized by using a vacuum lamp outer instead of the nitrogen fill outer conventionally used for the traditional quartz fill lamps. The heat conduction loss is reduced and the lamp efficiency is increased significantly.

11 Claims, 3 Drawing Sheets

QUARTZ METAL HALIDE LAMPS WITH HIGH LUMEN OUTPUT

FIELD OF THE INVENTION

This invention relates to improved metal halide lamps.

BACKGROUND OF INVENTION

Conventional metal halide lamps contain an electric light source comprising an arc discharge tube made of a vitreous material such as quartz or a high temperature glass, which is generally centrally disposed within a vitreous outer envelope and supported by a metal frame. The outer envelope generally has a stem or neck shaped portion on at least one end thereof, which terminates in a substantially metal base portion. The arc discharge tube or "arc tube" accommodated in the envelope is connected to the metal base by current supply conductors. The arc tube contains an electrode disposed at each end and contains a fill comprising mercury, a halide of sodium and a halide of one or more metals such as scandium, cesium, calcium, cadmium, zinc, barium, mercury, gallium, indium, thallium, germanium, tin, thorium, selenium, tellurium, etc. Usually, the arc tube also contains an inert gas such as argon. The discharge vessel is usually accommodated in a nitrogen filled tubular or ovoid outer envelope.

Increasing the lumen output for quartz metal halide lamps has been one of the major subjects in lamp research and development. Many improvements in the past have involved arc tube design changes such as arc tube geometry, chemical fillings, electrode dimensions, and wall loading. All of such improvements have used nitrogen or other inert gas filling in the outer bulbs. Because of high thermal conductivity of the filling gas such as nitrogen, part of the energy is lost through conduction.

Canadian Patent application 2,062,889, discloses that it has long been recognized that the chemistry encountered in metal halide lamps is such that ultraviolet radiation from the arc tube strikes metal components with the lamp causing the emission of photoelectrons; that under certain conditions, these photoelectrons collect on the outer surface of the arc tube and create a negative potential that attracts the positive sodium ions and accelerates their diffusion through the wall of the arc tube; that the production of such photoelectrons substantially accelerates the depletion of sodium within the arc tube and thus shortens the useful life of the lamp and that a design wherein silicon nitride coatings are employed on the surface of metal lamp components reduce the emission of photoelectrons from such metal lamp components and when deposited on the metal lamp components and the arc tube's outer surface retard or reduce the loss of sodium from within the arc tube. DE3134907 discloses a similar proposal wherein the outside of the discharge vessel, the metallic points holding this and supplying it with current, and the insulators, or metal parts, and a quartz tube are coated with silicon nitride to prevent alkali loss in metal halide lamps. However, these proposals use nitrogen filling gas so there is no increase in lumen output for the lamps.

There is a continuing need in the art for lamps in which the energy loss is reduced and wherein the lumen output is increased.

SUMMARY OF THE INVENTION

An object of the invention is to provide quartz metal halide lamps in which the energy loss is reduced.

Another object of the invention is to provide quartz metal halide lamps in which the energy loss is reduced and the lumen output is increased.

These and other objects of the invention are accomplished, according to a first embodiment of the invention in which energy loss is reduced significantly through the use of vacuum lamp outer envelops. The lamp lumen output is increased and up to 3,500 hours, the lamp lumen maintenance, color shift, voltage rise, and CRI shift of lamps produced in accordance with the invention are superior to conventional nitrogen fill lamps.

According to another and preferred embodiment the invention, high lumen output quartz metal halide lamps are provided which comprise a vacuum outer fill, and a silicon nitride CVD coating on the outside of the quartz arc tubes (discharge tubes). Instead of nitrogen filled outers, vacuum lamp outers are used for quartz metal halide lamps to reduce energy loss (since heat conduction loss is reduced) and to increase lumen output. Additionally, only the outside of the arc tubes is coated with silicon nitride, without coating the metal components. This reduces or blocks sodium diffusion through the quartz walls. The silicon nitride coating also retards migration of the trace hydrogen from the lamp outer into the arc tube.

A 10% to 15% increase in lumen output is realized by using a vacuum lamp outer instead of the nitrogen fill outer conventionally used for the traditional quartz fill lamps. The heat conduction loss is reduced and the lamp efficiency is increased significantly.

In especially preferred embodiments of the invention, a silicon nitride coating is employed only on the outside of the arc tubes (the metal components are not coasted) to reduced and/or block sodium diffusion through the quartz wall, and additionally, to achieve a target color temperature and further increase lumens for the lamp, salt ratios are reduced as required. We have discovered that the migration of trace hydrogen from the lamp outer into the arc tube can be retarded by applying the silicon nitride the outside or exterior of the arc tube. Because the sodium migration is blocked or reduced, the other changes in chemical fillings such as adjustment of salt ratios, reduction of excess metal for example, scandium, to reduce the reaction between scandium and quartz, and the addition of thorium iodide to improve the lamp performance may also be applied.

The invention will be better understood with reference to the details of specific embodiments that follow:

DESCRIPTION OF THE PREFERRED EMBODIMENTS

Figure 1:
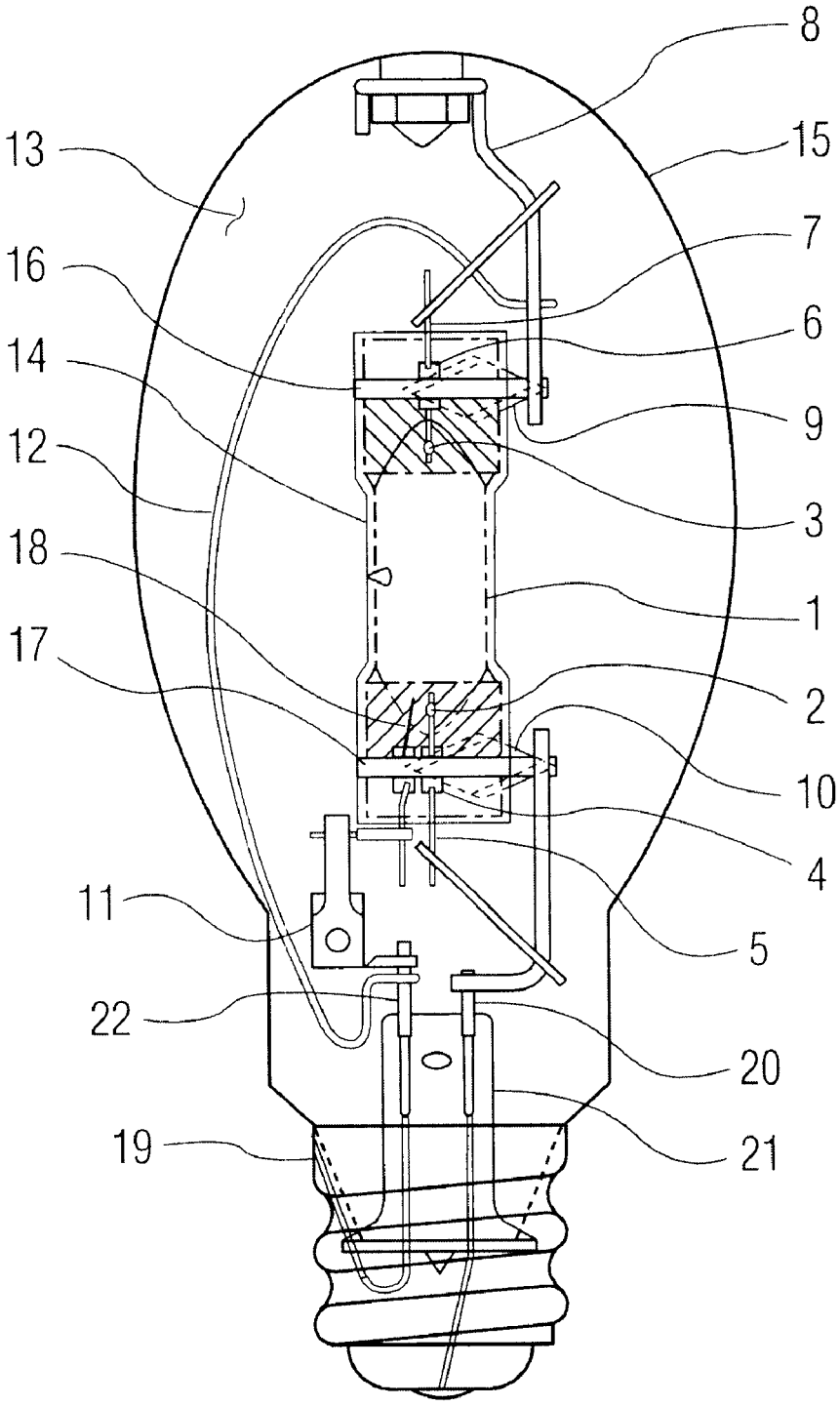
FIG. 1 is a schematic illustration of an embodiment of a metal halide lamp of the invention.

In accordance with the invention, with reference to FIG. 1, the numeral 1 denotes a quartz glass discharge vessel or arc tube which is filled with a fill comprising mercury, a halide of sodium and a halide of one or more metals such as scandium, cesium, calcium, zinc, cadmium, barium, mercury, gallium, indium, thallium, germanium, tin, thorium, selenium, tellurium, etc., and an inert gas such as argon. Generally, the iodides of these metals are preferred, although the bromides and, in some cases, chlorides may also be used. The arc tube may contain one or more of sodium iodide, bromide, or chloride, all as is well known in the art. In accordance with the invention, a coating 14 comprising silicon nitride, ($Si_3N_4$), is deposited on the outer surface of the arc tube 1, preferably by chemical vapor deposition (CVD) prior to assembly of the lamp components into the lamp. Preferably the arc tube is coated with about 30 nanometers and up to about 200 nanometers of silicon nitride.

Electrodes 2 and 3 are arranged in the discharge vessel 1. Electrode 2 is connected to current lead-through 4, 5. Electrode 3 is connected to current lead-through 6, 7. An auxiliary starting probe 18 and a switch 11 play a role during lamp starting. Two getters 9 and 10 function to absorb gas impurities within the outer 15 (the outer). The discharge vessel 1 is mounted on a frame comprising metal straps 16 and 17. Current conductor 8 is connected to current lead-through 6 and 7. The wire 12, current conductors 20 and 22, stem 21, and discharge vessel or arc tube 1 are accommodated in an evacuated ovoid or tubular glass outer 15. According to the invention, a vacuum exists in the space 13 between the arc tube 1 and the outer 15. The current conductors 20 and 22 are connected to the lamp cap 19. The current conductor 22 is connected to the cap shell 19, and the conductor 20 is connected to the cap eyelet 23.

It will be understood that the invention is equally applicable to quartz halide lamps of various internal construction and the benefits and advantages of the invention realized as long as the outer wall of the arc tube 1 is coated with silicon nitride 14 and the outer envelope 15 is evacuated.

Figure 2:
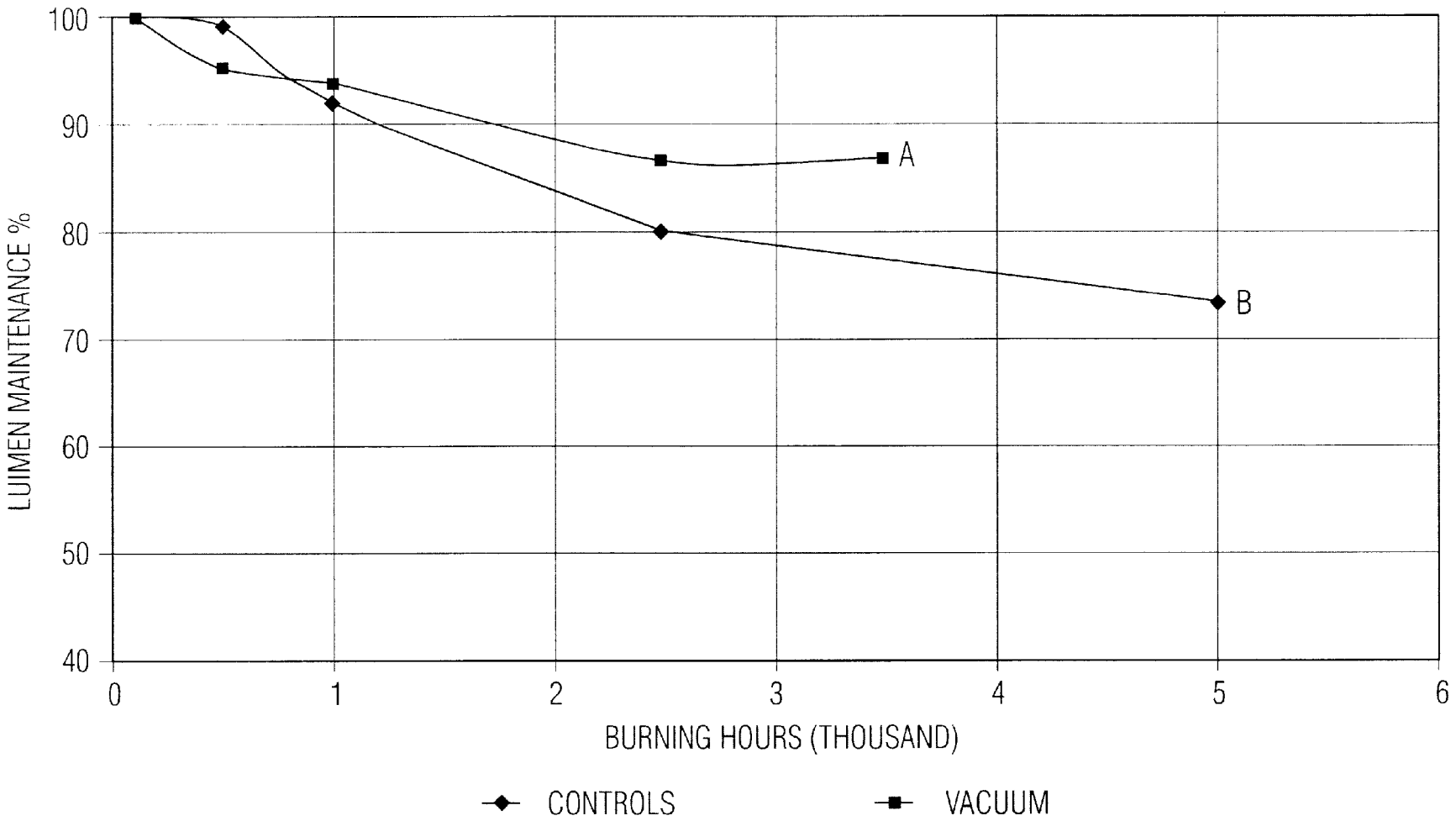
FIG. 2 is a graph of the lumen maintenance curve of representative lamps of the invention compared to lamps derived from a nitrogen filled control.
Figure 3:
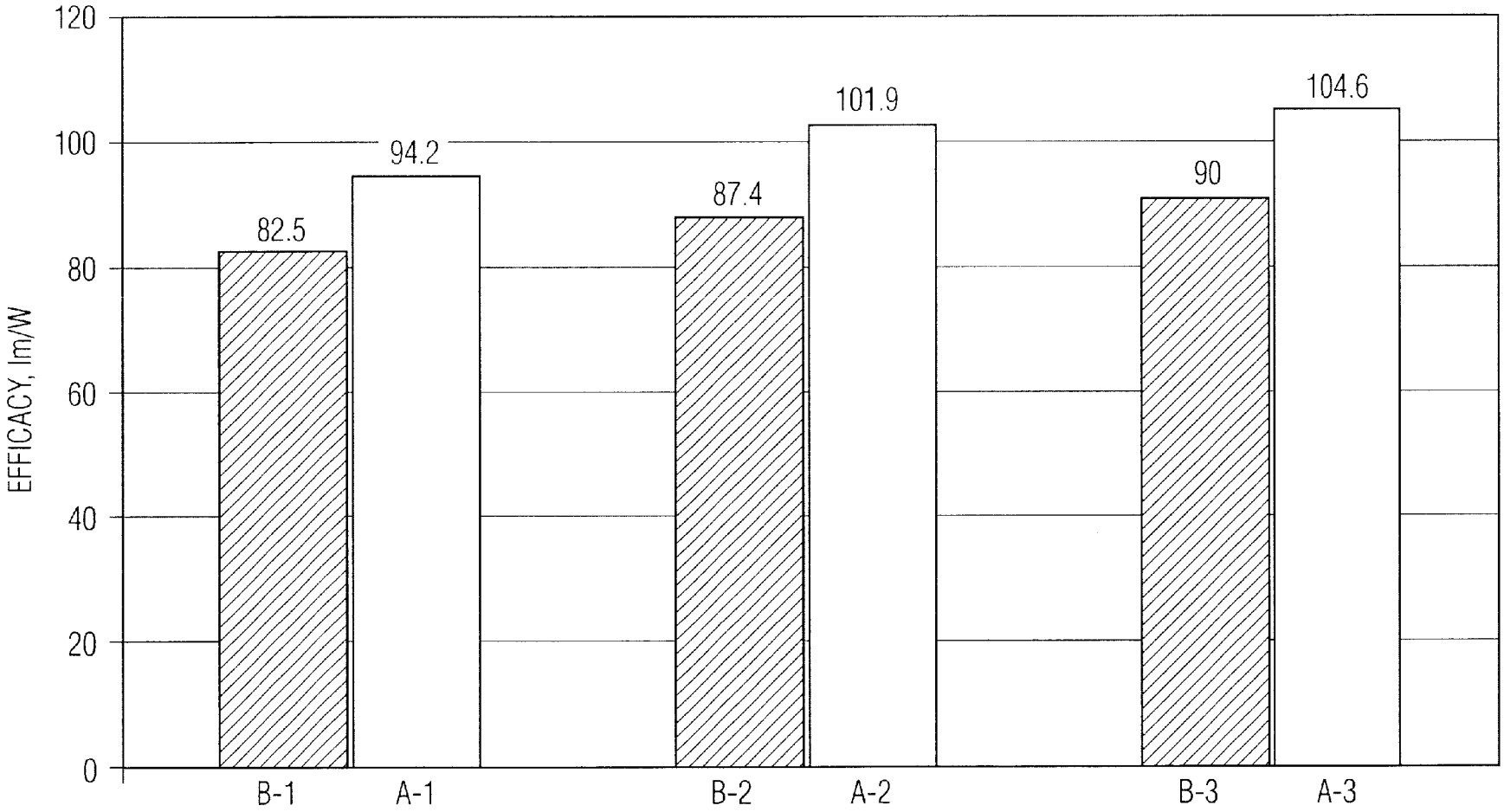
FIG. 3 is a graph of the lamp lumens at 100 hours of representative lamps of the invention compared to lamps derived from a nitrogen filled control.

Lamps of the invention were compared with lamps of the same construction. However, the lamps of the invention had a CVD coating of silicon nitride on the outer and were evacuated while the control lamps did not have a CVD coating of silicon nitride and were filled with nitrogen. Some of the results are given in FIGS. 2 and 3 which illustrate the lumen maintenance curve and the lamp lumens output at 100 hours wherein the (A) results are those obtained with the lamps of the invention. It will be seen that the invention increases the lamp lumen output by about 15% (See FIG. 2) and that the lamp performance is also improved significantly. Up to 3500 hours, the lamp lumen maintenance, color shift, voltage rise, and CRI shift for the lamps of the invention are found to be superior to the nitrogen fill lamps.

The invention may be embodied in other specific forms without departing from the spirit and scope or essential characteristics thereof, the present disclosed examples being only preferred embodiments thereof.

What is claimed is:

1. A metal halide discharge lamp which comprises:

an outer envelope having an inner wall; and an arc discharge tube having an outer wall disposed within said outer envelope; and means for increasing the lumen output of said lamp, said means comprising an evacuated space between the outer envelope and the outer surface of said arc discharge tube and a coating which comprises silicon nitride on at least a portion of the outer wall of the arc tube.

2. A metal halide discharge lamp as claimed in claim 1, wherein the lamp is a quartz metal halide lamp in which energy loss is reduced.

3. A metal halide discharge lamp as claimed in claim 1, wherein the lamp is a quartz metal halide lamp in which energy loss is reduced and the lumen output is increased.

4. In combination with a metal halide discharge lamp comprising an outer vitreous envelope, a plurality of metal lamp components within said outer vitreous envelope, an arc discharge tube having an inner surface and an outer surface, an ionizable mixture within said arc discharge tube including a sodium halide ionizable to a sodium ion and a halogen ion, said sodium ion being capable of diffusing from said inner surface of said arc discharge tube to said outer surface; and means for reducing diffusion of said sodium ions from said inner surface to said outer surface and for increasing the lumen output of lamps derived from said combination comprising: (a) an evacuated space between the outer vitreous envelope and the outer surface of said arc discharge tube, and (b) a coating which comprises silicon nitride deposited only on the outer surface of the arc discharge tube without coating the metal lamp components.

5. An improved output quartz metal halide lamp as claimed in claim 4, wherein the ionizable mixture also comprises thorium iodide.

6. An improved lumen output quartz metal halide lamp comprising:

an evacuated outer envelope having an inner wall;

a quartz arc discharge tube having an outer wall disposed within said evacuated outer envelope;

a plurality of metal lamp components disposed within said evacuated outer envelope; and a silicon nitride CVD coating on the outer wall of said quartz arc discharge tube, the metal lamp components being devoid of said silicon nitride coating.

7. A metal halide discharge lamp which comprises:

an evacuated outer envelope having an inner wall;

disposed within said evacuated outer envelope, a quartz glass discharge vessel which is filled with a fill comprising mercury, a halide of sodium and a halide of one or more metals selected from the group consisting of scandium, cesium, calcium, cadmium, barium, mercury, gallium, indium, thallium, germanium, tin, thorium, selenium, and tellurium, and an inert gas; said quartz glass discharge vessel having an outer wall;

a plurality of metal lamp components disposed within said evacuated outer envelope; and a silicon nitride CVD coating on the outer wall of said quartz glass discharge vessel, wherein the metal lamp components are devoid of said silicon nitride CVD coating.

8. A metal halide discharge lamp as claimed in claim 7, wherein said metal halides are metal iodides.

9. A metal halide discharge lamp as claimed in claim 8, wherein the quartz discharge vessel contains one or more of sodium iodide, bromide or chloride.

10. A method for reducing diffusion of said sodium ions in a metal halide discharge lamp including an arc discharge tube disposed within an outer vitreous envelope and for increasing the lumen output of such lamps which comprises:

providing (a) an evacuated space between the outer vitreous envelope and an outer surface of said arc discharge tube, and (b) a coating which comprises silicon nitride deposited on an outer surface of the arc discharge tube.

11. A method as claimed in claim 10, wherein uncoated metal halide lamp components are also present in said outer vitreous envelope.

* * * * *